United States Patent [19]

Cyphelly

[11] 4,144,798

[45] Mar. 20, 1979

[54] FLUID PRESSURE UNIT WITH HYDROSTATIC TORQUE TRANSMISSION BY ROLLER PISTONS

[76] Inventor: Ivan J. Cyphelly, Neuhaus, Hinteregg, Switzerland, 8128

[21] Appl. No.: 815,428

[22] Filed: Jul. 13, 1977

[30] Foreign Application Priority Data

Jul. 15, 1976 [CH] Switzerland ..... 9111/76
Jun. 14, 1977 [CH] Switzerland ..... 7303/77

[51] Int. Cl.[2] ..... F01B 13/06
[52] U.S. Cl. ..... 91/488
[58] Field of Search ..... 91/472, 491-501, 91/488, 489

[56] References Cited

U.S. PATENT DOCUMENTS

| | | | |
|---|---|---|---|
| 1,567,912 | 12/1925 | Carey | 91/472 |
| 3,433,124 | 3/1969 | Darrett | 91/501 |
| 3,435,774 | 4/1969 | Darrett | 91/501 |
| 3,636,821 | 1/1972 | Rystrom | 91/475 |
| 3,858,487 | 1/1975 | Abe | 91/489 |
| 3,866,519 | 2/1975 | Miyao | 91/488 |
| 3,884,124 | 5/1975 | Eddy | 91/491 |
| 3,960,057 | 6/1976 | Romotani | 91/488 |

FOREIGN PATENT DOCUMENTS

| | | | |
|---|---|---|---|
| 1299442 | 3/1969 | United Kingdom | 91/491 |

*Primary Examiner*—William L. Freeh
*Attorney, Agent, or Firm*—Browdy and Neimark

[57] ABSTRACT

A fluid pressure unit with a cylinder block is provided with radial bores of rectangular cross section. Pistons are disposed in the bores, each of the pistons being provided with a piston cap which is subjected periodically to pressure of a medium and with a roller resting against the piston cap. A cam is provided around the cylinder block, upon which the respective rollers rest. Each roller defines a variable throttle space with a first side wall of a respective one of the radial bores, which wall is vertical with respect to the rotational direction. The piston cap forms a sealing point with at least a second of two side walls.

7 Claims, 10 Drawing Figures

FLUID PRESSURE UNIT WITH HYDROSTATIC TORQUE TRANSMISSION BY ROLLER PISTONS

BACKGROUND OF THE INVENTION

This invention relates to a radial piston fluid pressure unit having a cylinder block, provided with radial bores of rectangular cross section, wherein pistons are disposed. The present invention relates more particularly to such a unit in which each of the pistons is provided with a piston cap periodically exposed to pressure from a medium and a roller mounted on the piston cap, and with a cam fitting around the cylinder block, the cam producing at least one stroke, with the rollers being supported on said cam.

In such a unit, with a radial arrangement of pistons, wherein the force of the pistons is converted into the appropriate torque by a stroke ring excentrically fitting around the rotor or a multi-stroke cam fitting around the rotor, the most important element in the force transmission chain is the pistons, interacting with the deflection of the force. It is necessary to have a good seal of the pressurized medium, high efficiency of force deflection, and a low mass for the oscillating and moving parts.

No solutions are known which meet all three requirements satisfactorily and simultaneously; either the good seal and deflection is obtained at the expense of a large mass of moving parts, whereby the speed is limited by the acceleration forces (so-called slow runners), or the conversion is unsatisfactory when the moving parts are of small mass (so-called fast runners).

SUMMARY OF THE INVENTION

The principal object of the present invention is to provide a unit of the type described above in which the pistons and conversion mechanism are arranged in such manner that the three requirements of sufficient seal, good conversion and small mass of moving parts are fulfilled to an approximately equal degree.

The invention is based on the fact that torque is transmitted through a hydrostatic pressure field.

According to the invention, the unit of the type described hereinabove is characterized by the fact that each roller forms a variable throttle space with a first of two side walls of a radial bore vertical with respect to the direction of rotation, and a piston cap forms a sealing point with at least a second one of two side walls of the bore. As a result, the intermediate pressure space located between the variable throttle space and the piston cap along the first side wall is exposed to the pressure of the medium through leakage spaces. The two lateral walls of the bore, which are parallel to the direction of rotation, are exposed via passages to the pressure medium.

In a unit according to the present invention, pressure distributions are produced accordingly on the rollers causing force conversion, the distributions simultaneously forcing adjustment of the throttle spaces and transmission of torque, as a result the two elements of each piston, namely the piston cap and the roller, act simultaneously in a sealing and force-transmitting fashion within a respective, rectangular piston bore. As a result of the play between the piston cap and the bore walls which are at right angles to the rotational direction, or when the piston cap rests in a sealing manner against two bore walls which are vertical with respect to the direction of rotation, and as a result of the leakage spaces of the piston cap, a fixed throttle for hydrostatic pocket positioning of the roller is automatically provided on the correct side of the piston, whereby a second, variable throttle is provided between the roller jacket surfaces and the bore wall on the same side of the piston. This hydrostatic pocket position is ensured by the fact that the walls of the bore which are parallel to the rotational direction are exposed to the pressure of the medium in the vicinity of the roller.

DESCRIPTION OF THE PREFERRED EMBODIMENTS

Figure 1:
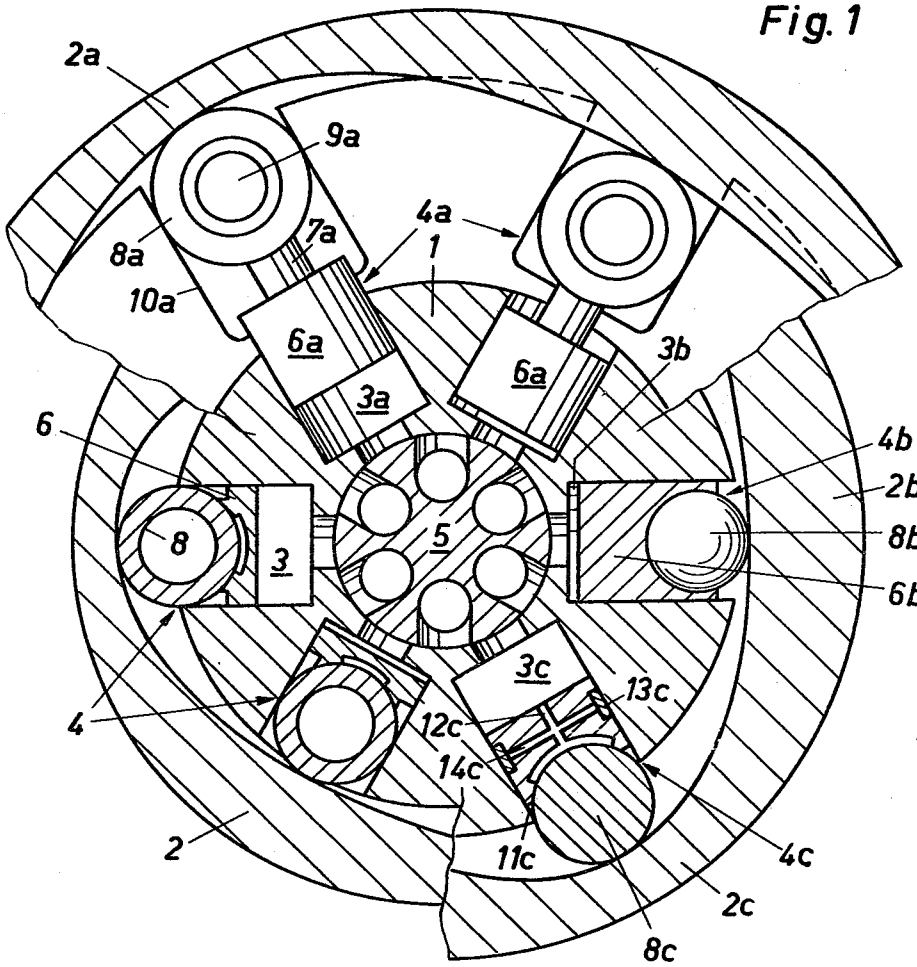
FIG. 1 is a cross section through a radial piston unit, showing four different piston arrangements, three being representative of prior art and a fourth illustrating a piston arrangement in a unit according to the present invention.

The radial piston unit represented in cross section at right angles to its rotational axis in FIG. 1, is provided with a cylinder block 1, surrounded by a cam 2*a*, 2*b*, 2*c*, 2 and radial bores 3*a*, 3*b*, 3*c*, 3, piston arrangements 4*a*, 4*b*, 4*c*, 4 being provided, to which a pressure medium is supplied by a distributor 5. The cylinder block 2 is rotatably disposed relative to cam 2*a*, 2*b*, 2*c*, 2 and the distributor 5, while cams 2*a*, 2*b*, 2*c*, 2 and the distributor are nonrotatably connected together. In FIG. 1, four different piston arrangements are represented sectorwise, by means of which the force exerted by the pressure medium upon the pistons is converted into a torque, namely the three piston arrangements 4*a*, 4*b*, 4*c* known per se, with their corresponding cam segments 2*a*, 2*b*, 2*c* and the piston arrangement 4 designed according to the present invention with its corresponding cam segment 2. The stroke and piston area, i.e., the intake volume per revolution, are assumed to be the same for all these designs. The distributor 5 is not described below in greater detail, since it has been described in U.S. Patent Application Ser. No. 630,348 filed on Nov. 10, 1975 and entitled "Hydraulic Apparatus Including Rotary Valve" and in Swiss Pat. No. 584,374.

In the first known piston arrangement 4*a*, there is a spatial separation of the piston and deflection functions. The pistons 6*a* disposed in the cylindrical bores 3*a* are connected by respective connecting rods 7*a* with respective cross member 9*a*, which support two sets of roller bearings 8*a*. One set of these roller bearings 8*a* is used for transfer of force by rolling on the cam 2*a*, while the other set transfers the torque to supporting members 10*a* connected to the cylinder block 1. Although a very high degree of efficiency of force transmission and good sealing effects are achieved with this embodiment, the high mass of the piston elements limits the speeds which can be achieved far too severely. In addition, the unavoidably large outside diameter of cam 2*a* and hence the machine is often disadvantageous in this design.

In the second known piston arrangement 4*b* shown in FIG. 1 the sealing and deflection functions are always kept separate, but are very constricted. The piston 6*b* disposed in the cylindrical bore 3*b* rests in a frictional manner upon a roller or ball 8*b*, which ensures force transmission by rolling upon the cam 2*b*. Once again the torque is transferred by friction from the ball 8*b* to the cylinder block 1. The large number of friction points results in a very poor mechanical efficiency but with a much reduced mass and smaller outside diameter for the cam 2*b* and hence the press.

The known piston arrangement 4*c*, which is similar to piston arrangement 4*b*, is disclosed in U.S. Pat. No. 3,699,848, and is provided with separate sealing and deflection functions. A cap-shaped piston 6*c* is disposed in the rectangular bore 3*c*, this piston resting upon a roller 8*c*, this roller in turn ensuring the deflection of force by rolling upon the cam 2*c*, whereby the torque is once again transferred from the roller 8*c* to the cylinder block 1. In order to reduce friction, a pocket 11*c* is provided between the roller 8*c* and the piston 6*c* at the support surface of the piston 6*c*, this pocket being exposed to pressure of medium through a radial bore 12*c* in thepiston 6*c*. Furthermore, the piston 6*c* is provided on all four lateral surfaces with seals 13*c*, which are also exposed to pressure of medium through the radial bore 12*c* and cross bores 14*c*, and consequently are pressed against the walls of the bore 3*c*. This known piston arrangement has somewhat smaller friction losses relative to piston arrangement 4*b*, but likewise has a poor mechanical efficiency as well as the danger of jamming of the piston 6*c* in the bore 6*c*.

In an embodiment of the present invention shown in the next sector of FIG. 1, the sealing and conversion function is combined in an automatically adjusted piston arrangement 4, which includes of a hollow roller 8 disposed in a rectangular bore 3 and a piston cap 6, so that a compact design results. Admittedly, conversion losses here are higher than in the known piston arrangement 4*a*, but the sealing effect is much higher and the mass is much smaller. In constrast with piston arrangements 4*b* and 4*c*, there is a higher mechanical efficiency (smaller conversion losses), still smaller mass, and higher compactness. Further details and the manner of operation of piston arrangement 4 will be discussed hereinbelow with reference to FIG. 2, which shows the piston arrangement 4 on an enlarged scale.

Figure 2:
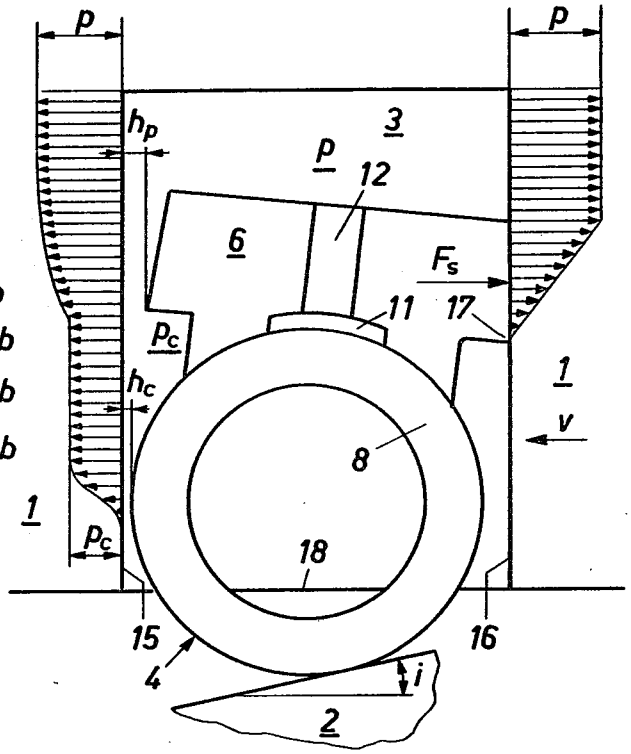
FIG. 2 is a cross section corresponding to FIG. 1 showing a piston designed according to the invention with a diagrammatic representation of the pressure distributions at a specific curve angle of the cam.

As shown in FIG. 2, the bore 3 of the cylinder block 1 has a rectangular cross section which contains the piston arrangement 4, the arrangement 4 including the piston cap 6 and the hollow roller 8 upon which the piston cap 6 rests an which, in turn, is pressed against the cam 2. As in the piston arrangement 4*c*, the piston cap 6 is provided with a pocket 11 on its contact surface with the roller 8, which is subjected to pressure p of the medium via a radial bore 12. Between lateral side walls 15 and 16 of the bore 3, which are perpendicular to the rotational direction, the piston cap 6 and the roller 8 are mounted with play.

The compressive force generated by the pressure p in the rectangular bore 3 is deflected by the piston cap 6 and the pocket 11 subjected to the pressure p upon the roller 8. By virtue of inclination i of the cam 2, the roller 8 is pressed leftward, whereby a space $h_c$ between the roller 8 and the bore wall 15 is made smaller in such fashion that, as a result of leakage at a space $h_p$ between the piston cap 6 and the bore wall 15, a pressure $p_c$ is created in the space between two spaces $h_c$ and $h_p$, this pressure on the one hand pressing the piston cap 6 with a force $F_s$ against the opposite bore wall 16 and, on the other hand, resulting in a lack of equilibrium in pressure distribution which confers a velocity v on the cylinder block 1. Simultaneously, the space between the roller 8 and the bore wall 16 becomes wider in such manner that no pressure appears from a contact point 17 of the piston cap 6 with the bore wall 16 up to an opening 18 of the piston bore 3. This pressure distribution is represented symbolically in FIG. 2 using arrows.

Figures 3A, 3B, 3C:
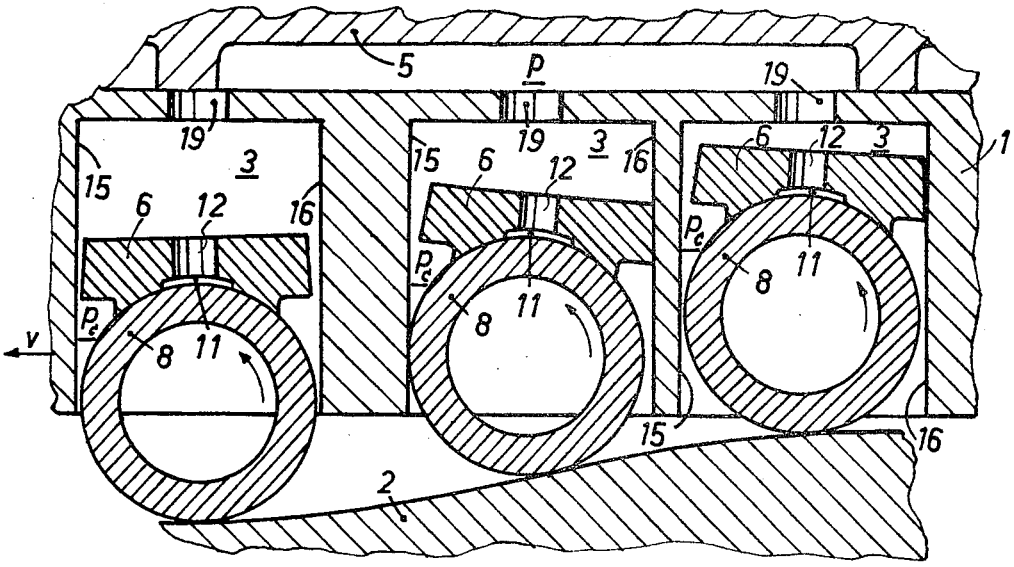
FIGS. 3*a*, 3*b*, and 3*c* represent a linear progression of the arrangement of pistons designed according to the invention in various positions of the cam when moving outward under pressure.
Figure 4:
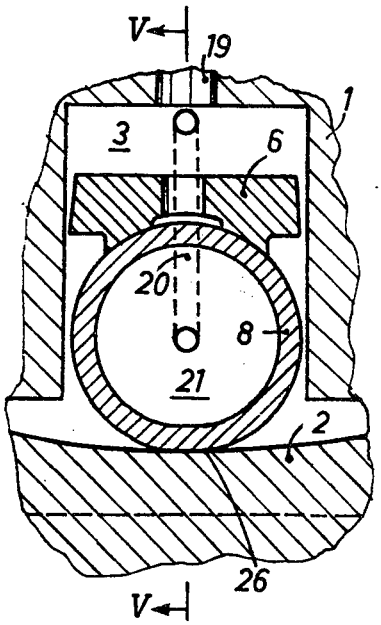
FIG. 4 is a cross section of an embodiment of the roller of the piston with pressure being applied to a roller bore.
Figure 5:
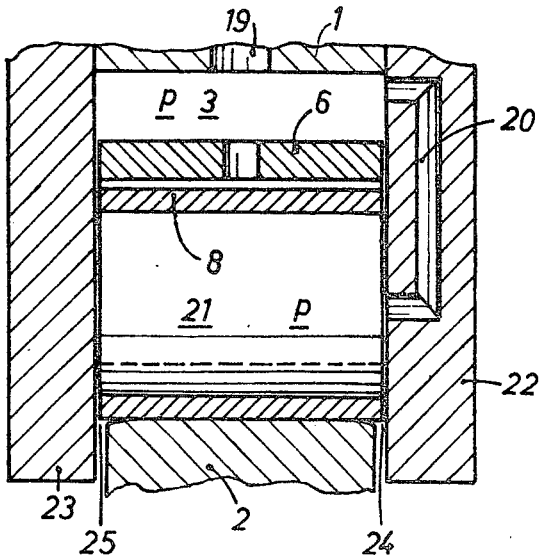
FIG. 5 is a cross section along section line V—V in FIG. 4.

In FIGS. 3*a* to 3*c*, in a linear progression, one may see how the distributor 5, with the motor operating, connects the piston cap 6 on a segment of the cam 2 with high pressure p of the medium via bores 19 in the cylinder block 1. The maximum force which can be transmitted from the cam 2 to the cylinder block 1 corresponds to a space $h_c = 0$, i.e., $p_c = p$. With the given geometric arrangement of the piston cap 6, this determines the maximum slope angle i of the cam 2, i.e., with an optimum arrangement, with maximum inclination of the curve, the roller 8 comes to rest against the wall 15 and exerts no force, as shown in FIG. 3*b*. With a smaller slope angle i, accordingly, a space combination is created which produces exactly pressure $p_c$, which corresponds to the force exerted by the cam 2 (FIG. 3*c*). With a very small slope angle i (FIG. 3*a*), the cap 6 lifts off the wall 15, since $p_c$, due to a lack of force transmission, becomes very small and the friction between the cap 6 and the roller 8 takes over. The design of the combination of cap and roller as shown in FIGS. 4 and 5 allows the lightest type of construction for maximum speeds. Here, a self-supporting thickness of the roller 8 is avoided, and a line 20 for high pressure p is guided into a roller bore 21 for the purpose. Side sealing plates 22 and 23 fit around the cam 2, so that the lateral play 24 and 25, for limiting the leakage is constantly maintained. The internal pressure therefore ensures the dimensional rigidity of the roller 8, but allows an increased local contact against a contact point 26 between the roller 8 and the cam 2, whereby a reduced pressure results in increased load-carrying capacity.

In the embodiments shown in FIGS. 2 to 5, of the piston arrangement according to the invention, the piston cap 6 and the spacing of the bore walls 15, 16 must be made very precisely in the rotational direction, since the play of the piston cap 6 between the bore walls 15, 16 determines the sealing space $h_p$ which in turn largely determines the leakage from the piston arrangement.

Figure 8:
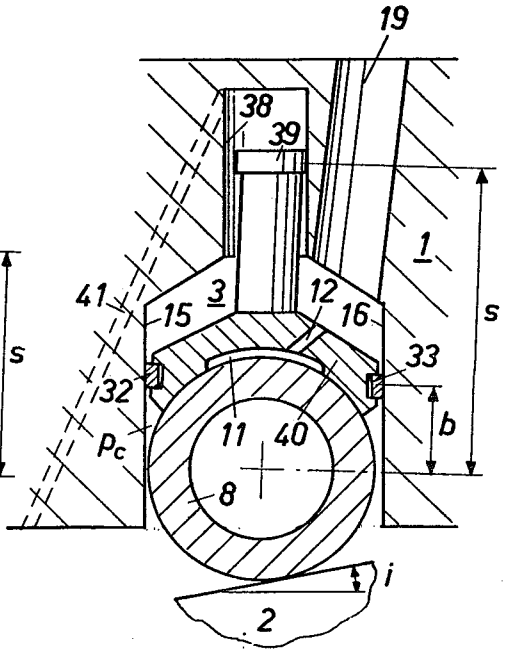
FIGS. 6, 7, and 8 each represent a cross section of respective further embodiments of units according to the present invention with piston caps of different constructions.

The embodiments shown in FIGS. 6 to 8 and described hereinbelow make it possible to avoid maintaining close tolerances for all dimensions in the rotational direction. This is accomplished by virtue of the fact that each piston cap, in the vicinity of the two side walls, vertical with respect to the rotational direction, of the radial bore are provided with adjustable sealing strips and of the fact that the intermediate pressure space located between the variable throttle space and one of the sealing strips of the piston cap is exposed to the pressure of the medium through leakage spaces between the two parallel side walls parallel to the rotational direction of the radial bore and the roller and piston cap. The formation of a sealing space $h_p$ between the piston cap and one of the bore walls which is vertical with respect to the rotational direction is thereby prevented, while the intermediate space which serves as a hydrostatic storage pocket is supplied with pressure $p_c$ only through leakage flow of pressure medium.

Figure 6:
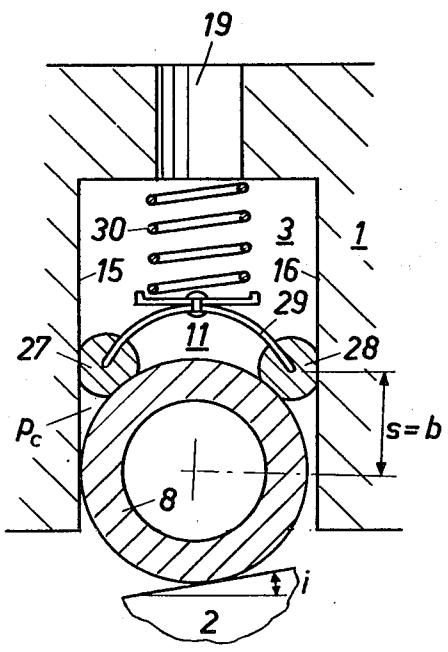

FIG. 6 shows a piston arrangement in which piston cap 6 of FIG. 2 is split into two sealing strips 27 and 28. In order to avoid tilting, the sealing strips 27 and 28, are connected together via an elastic holder 29. The holder 29 in turn is pressed toward the roller 8 by a spring 30 resting against the cylinder block 1.

The cam 2, the piston bore 3 and the roller 8 are the same as in the embodiment described previously. The pocket 11 is formed by the space between the sealing strips 29 and 30 and is subjected to the same pressure as the piston bore 3, this pressure being guided via the bore 19 in the cylinder block 1. A pressure $p_c$ in the space between the sealing strip 29, the roller 8, and the bore wall 15 is maintained by leakage gaps not visible in FIG. 6, between the end faces of the roller 8 and the side walls which delimit the latter, these walls being parallel to the rotational direction and being part of the piston bore 3 (cf. FIGS. 4 and 5), because the space defined by the roller 8 and/or the above-mentioned side walls are exposed to pressure p of the medium.

In the piston arrangement shown in FIG. 6, as a result of the wedge effect of the sealing strips 29 and 30, there is an increase in friction, so that this arrangement is suitable only for medium pressures and smaller slope angles i of the cam 2. In the embodiments shown in FIGS. 7 and 8, this disturbing wedge effect is eliminated by virtue of the fact that the sealing and supporting function of the piston cap is separated from bore walls 15 and 16.

Figure 7:
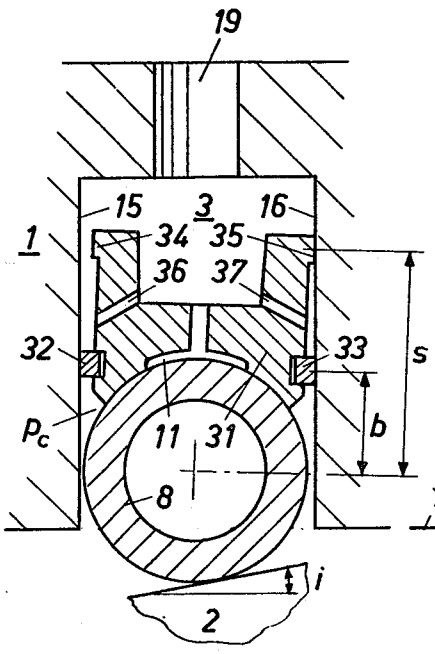

According to FIG. 7, sealing strips 32 and 33 are fixed into a cap body 31, whereby the pressure distribution on the bore walls 15 and 16 is determined. The tilting moment produced upon the cap formed in part by the cap body 31 by pressure distribution, which corresponds to that of the diagrammatic representation in FIG. 2, is taken up by upper portions of the cap designed as supporting ribs 34 and 35 extending upwardly from the cap body 31. The distance s of the supporting ribs 34 and 35 from the axis of rotation of the roller 8 is mathematically strictly linked to the distance b of the sealing strips 32 and 33 from the rotational axis of the roller 8 and with the maximum slope angle i of the cam 2. It is to be appreciated that the caps of the embodiments in FIGS. 1 to 6 correspond only to the limiting case s = b, as illustrated for example in FIG. 6.

The cam 2, the piston bore 3, the roller 8, and the pocket 11 are the same as in the piston arrangement of FIGS. 1 to 4. In the cap body 31 there are two additional bores 36 and 37 which ensure a correct pressure application between the supporting ribs 34, 35, and the sealing strips 32, 33.

The supporting force need not be taken up by the bore walls 15 and 16. As illustrated in FIG. 8, a smaller, pin-shaped projection 39, disposed in a guide bore 38 of a simplified cap body 40 will fully suffice for the purpose. This allows the smallest design, since the clearance in radial piston units, such as motors and the like, is formed by the radial depth of the broad bore, i.e., walls 15 and 16, and determines the latter at a given intake volume of the outside diameter of the unit. This is particularly true if, with the aid of lateral distribution, instead of the central distributor 5 in FIG. 1, the distance s of the guide projection 39 (FIG. 8) can be made large; this reduces distance b as a result of the overlap of distances s and b, and the inclination i. Moreover, by using a piston-shaped embodiment of the projection 39 and by evacuating the guide bore 38, via a bore 41 in the cylinder block 1, considerable compensation of the friction between the cap body 40 and the roller 8 can be achieved. The piston-shaped guide projection 39 in this case, of course, must rest in a sealing manner against the wall of the guide bore 38.

The cam 2, the roller 8, the pocket 11, and the sealing strips 32, 33 are the same as in the embodiment in FIG. 7; the bore walls 15 and 16, the piston bore 3 and the guide bore 19 are slightly modified to take into account the slightly different dimensions and geometric relationships.

It will be obvious to those skilled in the art that various changes may be made without departing from the scope of the invention and the invention is not to be considered limited to what is shown in the drawings and described in the specification.

What is claimed is:

1. In a fluid pressure unit having a cylinder block provided with radial bores of rectangular cross-section; pistons disposed in the bores, each of said pistons being provided with a piston cap which is to be subjected periodically to a pressure medium and with a roller resting against the piston cap; and cam means for producing at least one piston stroke per revolution positioned around the cylinder block and upon which the rollers rest, the improvement wherein each said roller, with a first lateral wall of a respective one of said bores which is perpendicular to the direction of rotation, defines a variable throttle space, wherein each of said piston caps forms a respective sealing means with at least a second lateral wall of a respective one of said bores which is perpendicular to the direction of rotation, wherein each said piston cap, in the vicinity of the two lateral walls of a corresponding one of said radial bores which are vertical with respect to the rotational direction, is provided with adjustable sealing strips, and including a respective intermediate pressure space located between one of said variable throttle spaces and one of said sealing strips of a corresponding one of said piston caps and being subjectable to pressure medium via respective leakage spaces between respective other lateral walls of respective ones of said radial bores which are parallel to the rotational direction and respective said rollers and corresponding said piston caps, each of said rollers being hollow, and including channel means which terminate in said lateral walls of said bores which are parallel to the rotational direction for supplying pressure fluid to spaces within said hollow rollers and to said leakage spaces, and wherein each said piston cap is provided with supporting elements to accept tilting moment of the associated piston, said elements resting against surfaces of said cylinder block and being spatially separated from sealing strips provided on the cap.

2. A unit according to claim 1, wherein said supporting elements are supporting ribs of a body of the piston cap, said ribs being located radially within said sealing strips which are adjustable and are at least partially positioned within said body of the piston cap, and which slide along the same lateral walls of the radial bore as do said sealing strips.

3. A unit according to claim 2, wherein said body of the piston cap is provided with a radially inwardly extending projection, said projection being supported in the rotational direction laterally in a respective guide bore of said cylinder block.

4. A unit according to claim 3, wherein said projection is made in the form of a piston sliding in said guide bore, and bore means in said cylinder for evacuating said bore means.

5. In a fluid pressure unit having a cylinder block providing with radial bores of rectangular cross-section; pistons disposed in the bores, each of said pistons being provided with a piston cap which is to be subjected periodically to a pressure medium and with a roller resting against the piston cap; and cam means for producing at least one piston stroke per revolution positioned around the cylinder block and upon which the rollers rest, the improvement wherein each said roller, with a first lateral wall of a respective one of daid bores which is perpendicular to the direction of rotation, defines a variable throttle space, wherein each of said piston caps forms a respective sealing means with at least a second lateral wall of a respective one of said bores which is perpendicular to the direction of rotation, a respective intermediate pressure space located between each of said variable throttle spaces and a corresponding one of said piston caps via respective leakage gap means along respective ones of said first lateral side walls for exposing respective ones of said throttle spaces to pressure medium, and respective passage means for exposing other lateral walls of respective ones of said radial bores, which are parallel to the direction of rotation, at least in the vicinity of ends of each said roller to pressure medium, wherein each said piston cap, in the vicinity of the two lateral walls of a corresponding one of said radial bores which are vertical with respect to the rotational direction, is provided with adjustable sealing strips, each of said intermediate pressure spaces being located between one of said variable throttle spaces and one of said sealing strips of a corresponding one of piston caps and being subjectable to pressure medium via respective said leakage spaces between respective said two lateral walls of respective said radial bores which are parallel to the rotational direction and respective said rollers and corresponding said piston caps, wherein each said piston cap includes a body and is provided with supporting elements to accept tilting moment of the associated piston, said elements resting against surfaces of said cylinder block and being spatially separated from sealing strips provided on the cap, and wherein said body of the piston cap is provided with a radially inwardly extending projection, said projection being supported in the rotational direction laterally in a respective guide bore of said cylinder block.

6. A unit according to claim 5, wherein said projection is made in the form of a piston sliding in said guide bore, and bore means in said cylinder block for evacuating said bore means.

7. In a fluid pressure unit having a cylinder block provided with radial bores of rectangular cross-section, pistons disposed in the bores, each of said pistons being provided with a piston cap which is to be subjected periodically to a pressure medium and with a roller resting against the piston cap; and cam means for producing at least one piston stroke per revolution positioned around the cylinder block and upon which the rollers rest, the improvement wherein each said roller, with a first lateral wall of a respective one of said bores which is perpendicular to the direction of rotation, defines a variable throttle space, wherein each of said piston caps forms a respective sealing means with at least a second lateral wall of a respective one of said bores which is perpendicular to the direction of rotation, wherein each said piston cap, in the vicinity of the two lateral walls of a corresponding one of said radial bores which are vertical with respect to the rotational direction, is provided with adjustable sealing strips, and including a respective intermediate pressure space located between one of said variable throttle spaces and one of said sealing strips of a corresponding one of said piston caps and being subjectable to pressure medium via respective leakage spaces between respective other lateral walls of respective ones of said radial bores which are parallel to the rotational direction and respective said rollers and corresponding said piston caps, each of said rollers being hollow, and including channel means which terminate in said lateral walls of said bores which are parallel to the rotational direction for supplying pressure fluid to spaces within said hollow rollers and to said leakage spaces.

* * * * *